US009951479B2

(12) United States Patent
Gardner et al.

(10) Patent No.: US 9,951,479 B2
(45) Date of Patent: Apr. 24, 2018

(54) RAILWAY RAIL FASTENING CLIP AND PAD FOR RECESSED RAILSEATS

(71) Applicant: Pandrol Limited, Addlestone, Surrey (GB)

(72) Inventors: Christopher Gardner, Worksop (GB); Stephen John Cox, Richmond (GB)

(73) Assignee: Pandrol Limited, Addlestone, Surrey (GB)

( * ) Notice: Subject to any disclaimer, the term of this patent is extended or adjusted under 35 U.S.C. 154(b) by 0 days.

(21) Appl. No.: 15/380,233

(22) Filed: Dec. 15, 2016

(65) Prior Publication Data

US 2017/0226701 A1 Aug. 10, 2017

Related U.S. Application Data

(62) Division of application No. 14/406,183, filed as application No. PCT/GB2013/051024 on Apr. 23, 2013, now Pat. No. 9,562,330.

(51) Int. Cl.

| | |
|---|---|
| ***E01B 9/30*** | (2006.01) |
| ***E01B 9/68*** | (2006.01) |
| ***E01B 9/60*** | (2006.01) |

(52) U.S. Cl.

CPC ..... *E01B 9/303* (2013.01); *E01B 9/60* (2013.01); *E01B 9/685* (2013.01)

(58) Field of Classification Search

CPC . E01B 9/303; E01B 9/483; E01B 9/30; E01B 9/685; E01B 9/34; E01B 9/46;

(Continued)

(56) References Cited

U.S. PATENT DOCUMENTS 5,520,330 A 5/1996 Brown et al.
5,735,458 A 4/1998 Brown et al.

(Continued)

FOREIGN PATENT DOCUMENTS

CN 1035537 A 9/1989
CN 1088280 A 6/1994

(Continued)

OTHER PUBLICATIONS

First Chinese Office Action, dated Aug. 27, 2015, corresponding to Chinese Patent Application No. 201380031037.4.

(Continued)

*Primary Examiner* — Mark T Le
(74) *Attorney, Agent, or Firm* — Husch Blackwell LLP

(57) ABSTRACT

A rail pad can have a major face forming a railseat portion on which a foot of a railway rail sits when the pad is in use, the railseat portion having opposite side edges to at least part of each of which a respective upstanding portion of the pad can be connected, wherein the pad does not have any part which extends laterally from the railseat portion in a same plane as the railseat portion. The respective upstanding portion can be connected to a projection of the rail pad which extends laterally from the respective upstanding portion such that the projection can be vertically spaced from, and does not overhang, the railseat portion, the projection spaced from ends of the respective upstanding portion such that the projection can be configured to interlock with a corresponding opening in a front part of one of the railway rail clip anchoring devices.

10 Claims, 6 Drawing Sheets

(58) Field of Classification Search
CPC ... E01B 9/48; E01B 9/60; E01B 9/686; E01B 9/681; E01B 2205/00; E01B 9/68; E01B 9/306; E01B 9/683
USPC ..... 238/349, 351, 306
See application file for complete search history.

(56) References Cited

U.S. PATENT DOCUMENTS

| | | | |
|---|---|---|---|
| 6,027,034 | A | 2/2000 | Demmig et al. |
| 6,702,192 | B2 | 5/2004 | Igwemezie |
| 7,845,578 | B2 | 12/2010 | Cox et al. |
| 8,973,846 | B2 | 3/2015 | Buda |
| 2002/0000475 | A1 | 1/2002 | Igwemesrie |
| 2011/0315784 | A1 | 12/2011 | Bosterling et al. |
| 2012/0111959 | A1 | 5/2012 | Krieg |
| 2012/0111960 | A1 | 5/2012 | Bosterling |
| 2014/0103132 | A1 | 4/2014 | Lienhard et al. |

FOREIGN PATENT DOCUMENTS

| | | | |
|---|---|---|---|
| DE | 10 2004 033 724 | B3 | 10/2005 |
| EP | 0 232 029 | A2 | 8/1987 |
| EP | 0 313 325 | B1 | 9/1991 |
| EP | 0 512 758 | A1 | 11/1992 |
| EP | 1 077 287 | A2 | 2/2011 |
| GB | 2 211 231 | A | 6/1989 |
| GB | 2 235 003 | A | 2/1991 |
| GB | 2 435 285 | A | 8/2007 |
| WO | WO 93/12296 | | 6/1993 |
| WO | WO 2010/116118 | * | 10/2010 |
| WO | WO 2012/025201 | A1 | 3/2012 |

OTHER PUBLICATIONS

English language translation of First Chinese Office Action, dated Aug. 27, 2015, corresponding to Chinese Patent Application No. 201380031037.4.

Extended European Search Report, dated Oct. 2, 2015, corresponding to European Application No. EP 15 16 4446.

Great Britain Intellectual Property Office's Search Report, dated Sep. 4, 2012, corresponding to Great Britain Application No. GB1210365.1.

Great Britain Intellectual Property Office's Further Search Report, dated Dec. 19, 2012, corresponding to Great Britain Application No. GB1210365.1.

PCT International Search Report, dated Jan. 28, 2014, corresponding to International Application No. PCT/GB2013/051024.

English language translation of abstract of Chinese Publication No. CN1035537 (A).

English language translation of abstract of Chinese Publication No. CN1088280 (A).

English language translation of abstract of German Publication No. DE102004033724.

* cited by examiner

PRIOR ART

RAILWAY RAIL FASTENING CLIP AND PAD FOR RECESSED RAILSEATS

FIELD OF THE INVENTION

The present invention relates to a railway rail fastening clip and railway rail pad for recessed railseats.

BACKGROUND OF THE INVENTION

A recessed railseat is a transverse recess (channel) in the top surface of a concrete railway sleeper for receiving the foot of a railway rail. Respective railway rail clip anchoring devices (shoulders) are provided on either side of the recess for retaining resilient railway rail fastening clips which bear on the rail foot. An example of such a rail fastening clip is known from GB1510224, which is a clip of the type which is driven onto the rail foot in a direction parallel to the longitudinal axis of the rail.

Railway rail fastening clips are known, for example from EP0619852A as shown in FIG. 1A and EP1987201A as shown in FIG. 1B, which are designed to be driven onto a rail foot laterally with respect to the longitudinal axis of the rail. One advantage of such clips is that they can be driven more readily by automatic machinery. One type of automatic clip driving machinery has paddles which are set at a certain height such that as they sweep they come into contact with the rear arches (heel) of the clip but do not touch the sleeper surface or any part of the anchoring device.

It is desirable to provide a railway rail fastening clip of a type which can be driven laterally by the afore-mentioned type of automatic clip driving machinery onto a railway rail seated in a recessed railseat.

SUMMARY OF THE INVENTION

According to an embodiment of a first aspect of the present invention there is provided a resilient railway rail fastening clip for fastening a railway rail to an underlying foundation, the clip being such that it can be deflected from a non-operative configuration to at least one operative configuration in which a toe portion of the clip bears on a railway rail, the clip being made from a rod of resilient material shaped so as to have, proceeding from one end of the rod to the other end of the rod, firstly a substantially straight first portion, then a substantially bent second portion, then a third portion, then a fourth portion which is substantially U-shaped and forms the toe portion of the clip, then a fifth portion, then a substantially bent sixth portion, and finally a substantially straight seventh portion, the first and seventh portions of the clip forming leg portions, the longitudinal axes of which lie substantially in a first plane when the clip is in its non-operative configuration and, when the clip is viewed in a direction perpendicular to the said first plane, the third and fifth portions appear to lie between the first and seventh portions, wherein, when the clip is in its non-operative configuration, the second and sixth portions extend substantially away from and above the first plane and at least parts of the third and fifth portions extend towards and above the first plane such that the longitudinal axes of the third and fifth portions lie substantially in a second plane, different from the said first plane, which second plane intfarsects the first plane at a first acute angle $\alpha$, and the fourth portion extends substantially in or below the said first plane such that the longitudinal axis of the fourth portion lies substantially in a third plane which is different to the said second plane and intersects the said first plane at a second acute angle $\beta$, where $0° \leq \beta < \alpha$.

In one embodiment of the clip, substantially all parts of the third and fifth portions extend towards and above the first plane.

In a preferred embodiment of the clip, $15° \leq \alpha \leq 45°$ and $0° < \beta \leq 20°$, such that $0° \leq \beta < \alpha$.

By virtue of its shape, a clip embodying the first aspect of the present invention can be used to fasten a rail located in a recessed rail seat and is capable of being driven laterally onto the rail foot by the aforementioned automatic machinery.

When a rail is seated in a recessed railseat the edges of the rail foot bear against respective electrically-insulating wear pieces (sidepost insulators) that typically extend along the entire length of the channel, that is across the whole width of the sleeper surface. The sidepost insulators usually comprise members of L-shaped section, one part of the L sitting on the top surface of the sleeper and the other part of the L extending down a side wall of the railseat recess towards the floor of the railseat recess. A railway rail pad, comprising a plate of resilient material for providing cushioning between the rail foot and the underlying sleeper, is provided on the floor of the railseat recess, usually such that ends of the sidepost insulators are located beneath the pad.

Some recessed railseats are provided with pads which have a trough-like structure in which upstanding portions of electrically insulating material, which serve as sidepost insulators for insulating the anchoring device from the rail, are attached to a railseat portion along its entire length so as to form a channel. However, such pads can be subject to the problem of longitudinal migration, i.e. the pad moves along the sleeper surface as the rail above moves under the passage of rail traffic.

A different form of rail cushioning pad is known from EP1987201A in which the railseat portion of the pad is integrally formed, along central parts of its opposite edges, with sidepost insulators. The pad has parts connected to corners of the railseat portion which extend laterally therefrom to provide ears between which a recess for receiving the front part of an anchoring device is defined. The ears are provided in order to overcome the problem of longitudinal migration of the pad. However, owing to the ears, such a pad cannot be used in a recessed railseat.

It is desirable to provide a rail pad with integral sidepost insulators which can be used in a recessed railseat.

According to an embodiment of a second aspect of the present invention there is provided a rail pad for use, as cushioning and/or electrical insulation, beneath a foot of a railway rail in a recess formed in an upper surface of a rail foundation, the pad having a major face forming a railseat portion on which the foot of the railway rail sits when the rail pad is in use, the railseat portion having opposite side edges to at least part of each of which an upstanding portion of the pad is connected, each upstanding portion being connected to the railseat portion along the entire length of the upstanding portion and extending upwardly therefrom, wherein the pad does not have any part which extends laterally from the railseat portion in the same plane as the railseat portion, and wherein each upstanding portion is connected to at least one projection of the pad which extends laterally from the upstanding portion such that it is vertically spaced from, and does not overhang, the rail seat portion, the said projection extending along only part of the length of the upstanding portion at a location along the length of the upstanding portion which is spaced from ends thereof.

The projection on each upstanding portion serves to prevent longitudinal movement of the pad in the recess by interlocking with a corresponding opening in the front part of the railway rail anchoring device located adjacent to the recess.

There may be two or more such projections, spaced apart along the length of the upstanding portion.

Concrete erosion, caused by water carrying grit, is a problem at the pad/sleeper interface. As the upper surface of the rail foot is inclined, water falling on the rail foot rolls down the upper surfaces of the rail foot into the small gaps between the rail edge and the front face of the sidepost insulator; water will also flow off of the top surface of the sleeper into the gaps between the rail edges and sidepost insulators (especially if the rail track is also canted). If, as is typically the case, there is no seal between the sidepost insulators and the rail pad, such water, and any grit it is carrying, can penetrate down the side of the pad to the concrete sleeper surface and be drawn in under the pad. Rail pads need to be replaced regularly as part of the normal track maintenance program, but significant erosion of the concrete sleeper surface can usually be addressed only by expensive repair or replacement of the sleeper.

The afore-mentioned trough-shaped rail pads, by virtue of the fact that the sidepost insulators are sealed to the railseat portion of the pad, prevent water which has rolled down between the rail foot edge and the front face of the side post from reaching the sleeper/pad interface beneath the rail. However, water falling on the top of the sleeper and flowing back down towards the rail is able to drop down between the edge of the recess and the back face of the sidepost insulator, and make its way down onto the concrete surface beneath the pad, potentially causing erosion. With a view to overcoming this problem, a rail pad embodying the second aspect of the present invention preferably further comprises cover portions connected to, and extending laterally from, each upstanding portion at locations along its length. In such a rail pad the cover portions serve to cover the gaps between the side edges of the pad and the side walls of the sleeper recess, thereby diverting water away.

In one embodiment the upstanding portion may be connected along its entire length to either a projection or a cover portion. In this case, at least one cover portion which is located immediately adjacent to a projection is provided with a notch for receiving part of a railway rail anchoring device.

Alternatively, a rail pad embodying the invention has a gap between at least one cover portion and one of the projections located immediately adjacent thereto for receiving part of a railway rail anchoring device.

Upper surfaces of the said projections may be higher with respect to the rail seat portion than upper surfaces of the said cover portions.

According to an embodiment of a third aspect of the present invention there is provided apparatus comprising a rail pad embodying the second aspect of the present invention and a railway rail foundation having an upper surface formed with a recess providing a seat for a railway rail, respective railway rail clip anchoring devices being attached to the rail foundation on opposite sides of the recess, the front part of each anchoring device having an opening, wherein, when the railseat portion of the pad is located in the recess, the projections of the rail pad project into the openings.

In one embodiment of the apparatus, front parts of the anchoring devices are spaced from edges of the recess.

BRIEF DESCRIPTION OF DRAWINGS

Reference will now be made to the accompanying drawings in which.

DETAILED DESCRIPTION OF PREFERRED EMBODIMENTS

Figure 2A:
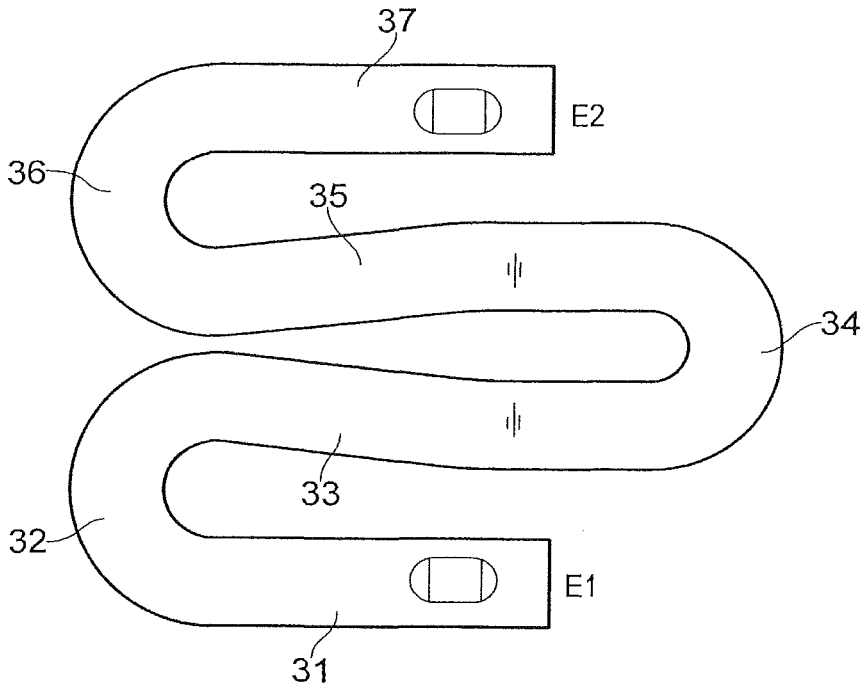
FIG. 2A, FIG. 2B, and FIG. 2C show respective plan, front elevational and side elevational views of a railway rail fastening clip embodying the first aspect of the present invention.
Figure 2B:
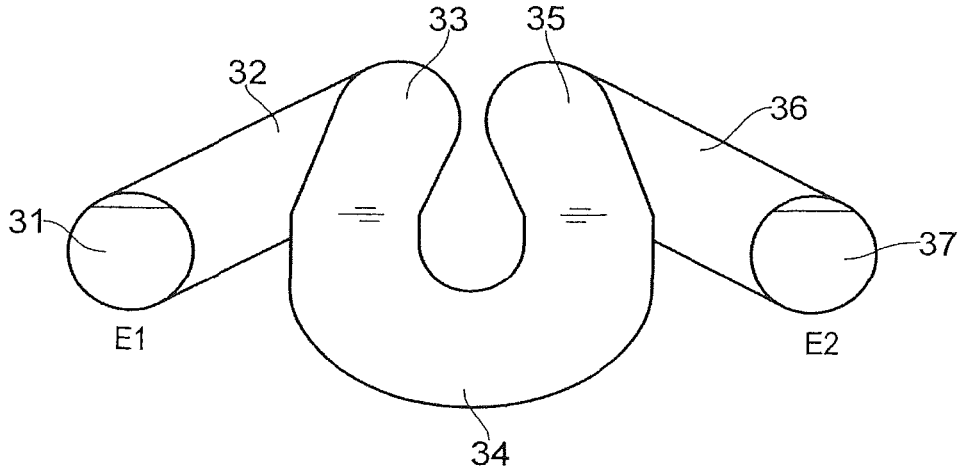
Figure 2C:
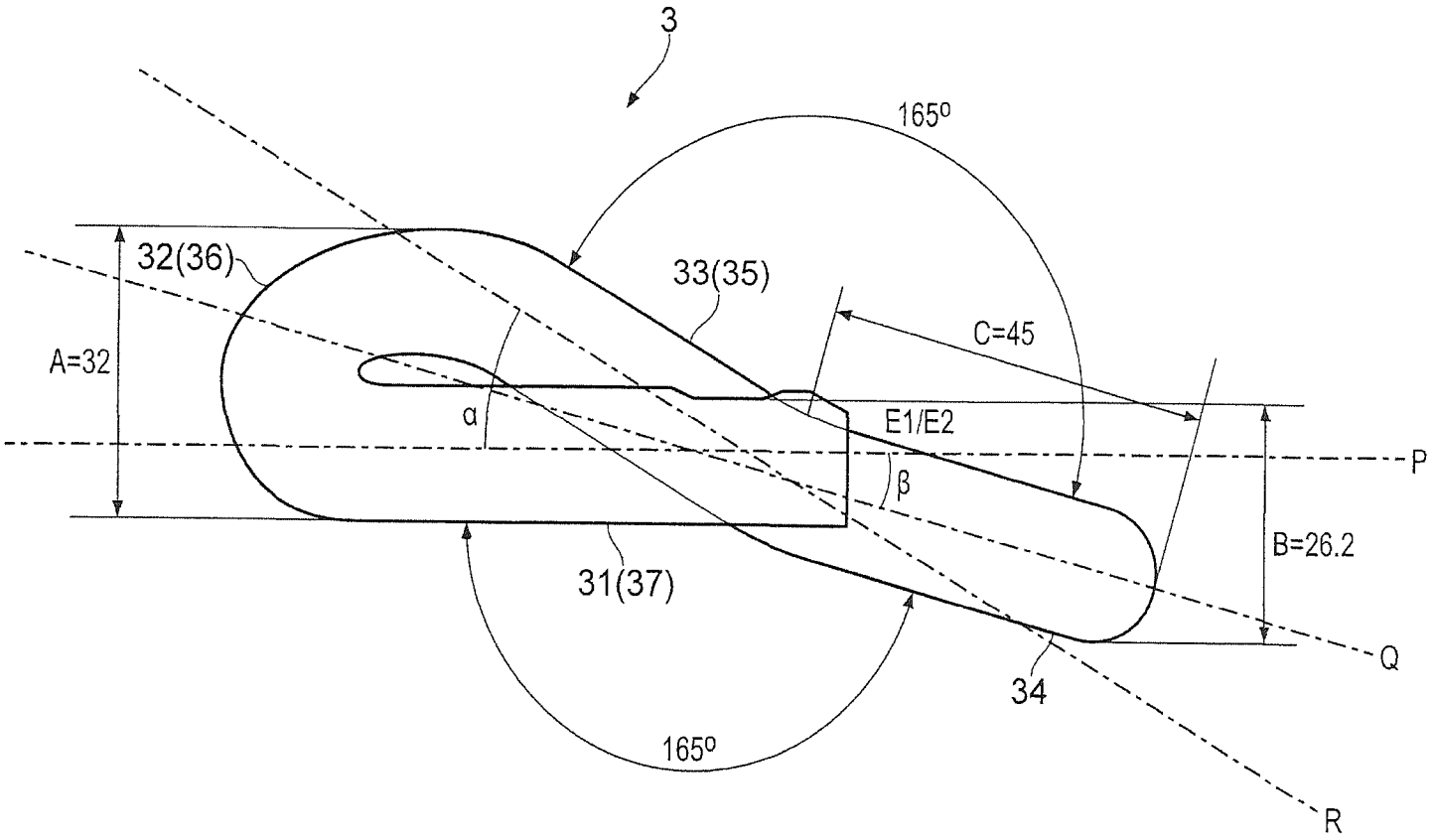

FIGS. 2A to 2C show a resilient railway rail fastening clip 3 for fastening a railway rail to an underlying foundation, the clip being such that, through driving the clip into a suitable railway rail clip anchoring device, it can be deflected from a non-operative (unstressed) configuration to at least one operative (stressed) configuration in which a toe portion 34 of the clip 3 bears on a railway rail.

The clip 3 has successive first to seventh portions 31 to 37 where, when the clip 3 is in a non-operative configuration, the first and seventh portions 31, 37 of the clip 3 form leg portions which lie in a first plane P, the second and sixth portions extend substantially away from and above the first plane P, at least parts of the third and fifth portions 33, 35 extend towards and above the first plane P such that the longitudinal axes of the third and fifth portions 33, 35 lie substantially in a second plane R, different from the said first plane P, which second plane R intersects the first plane P at a first acute angle $\alpha$, and the fourth portion 34 extends substantially in or below the said first plane P such that the longitudinal axis of the fourth portion 34 lies substantially in a third plane Q which is different to the said second plane R and intersects the said first plane P at a second acute angle $\beta$, where $0° \leq \beta < \alpha$.

In particular, the clip 3 is made from a rod of resilient material shaped so as to have, proceeding from one end E1 of the rod to the other end E2 of the rod, firstly a substantially straight first portion 31, then a substantially bent second portion 32, then a third portion 33, then a fourth portion 34 which is substantially U-shaped and forms the toe portion of the clip, then a fifth portion 35, then a substantially bent sixth portion 36, and finally a substantially straight seventh portion 37, the first and seventh portions 31, 37 of the clip 3 forming leg portions for engaging a railway rail clip anchoring device (see FIGS. 4, 5A, 5B, and 5C) and the second and sixth portions 32, 36 forming rear arches which provide the heel portions of the clip. The longitudinal axes of the first and seventh portions lie substantially in a first plane P when the clip 3 is in its non-operative configuration and, when the clip 3 is viewed in a direction perpendicular to the said first plane P, the third and fifth portions 33, 35 (centre body) appear to lie between the first and seventh portions 31, 37 and the fourth portion extends beyond the ends E1 and E2 of the rod. When the clip 3 is in its non-operative configuration, as shown in FIGS. 2A to 2C, the second and sixth portions extend substantially away from and above the first plane P and the third and fifth portions 33, 35 extend substantially towards and above the first plane P such that the longitudinal axes of the third and fifth portions 33, 35 lie substantially in a second plane R, different from the said first plane P, which second plane R intersects the first plane P at a first acute angle $\alpha$, and the fourth portion 34 extends substantially below the said first plane P such that the longitudinal axis of the fourth portion 34 lies substantially in a third plane Q which is different to the said second plane R. In this embodiment the third plane Q is also different from the first plane P. The third plane Q intersects the said first plane P at a second acute angle $\beta$ which is smaller than the said first acute angle $\alpha$.

Figure 5B:
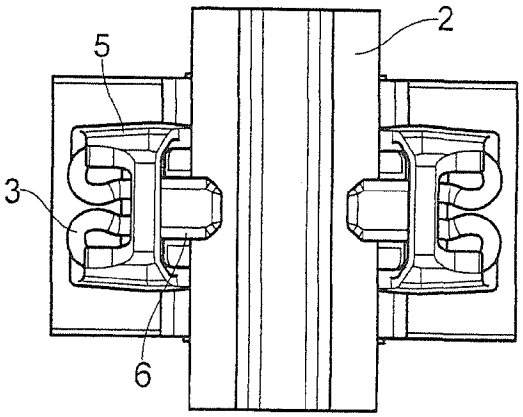
FIG. 5A, FIG. 5B, and FIG. 5C show an assembly comprising railway rail fastening clips embodying the first aspect of the present invention together with an apparatus embodying the third aspect of the present invention.
Figure 5C:
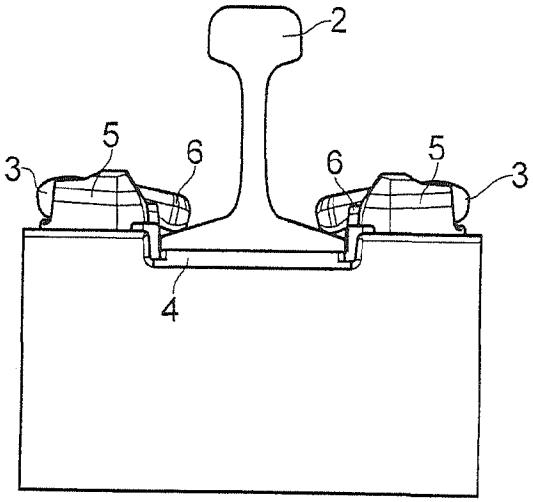
Figure 5A:
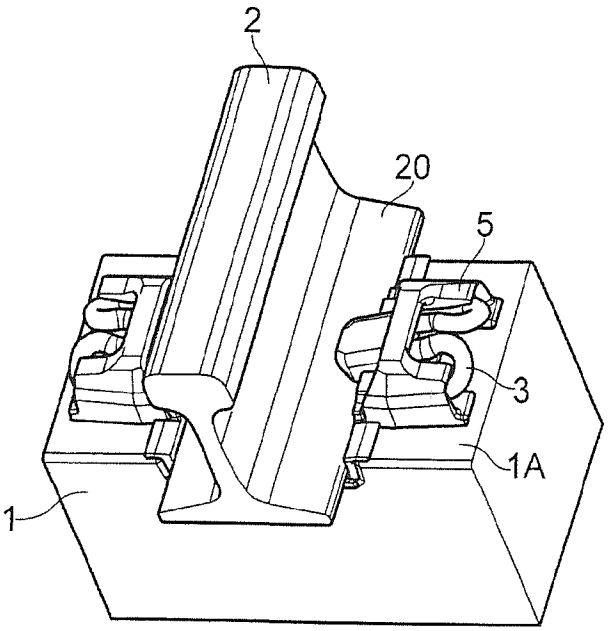

Taking the first plane P of the leg portions 31, 37 as a datum, the rear arches (heel portion) 32, 36 of the clip 3 first rise up to provide sufficient height at the back of the clip 3 to allow for driving of the clip 3 onto the rail (see FIGS. 5A, 5B, and 5C). The centre body 33, 35 of the clip 3 then descends steeply, but then bends back up, such that the toe portion that is driven onto the rail 2 is much more nearly horizontal when in the operating position. The shape of the clip permits the clip to be used with a rail located in a recessed railseat, whilst reducing the risk of the clip stalling (becoming stuck) or a toe insulator 6 carried by the toe of the clip (shown in FIGS. 5A, 5B, and 5C) being damaged as the clip is driven onto the rail.

In the embodiment described above substantially all of the third and fifth portions 33, 35 extend above the first plane P, but in other embodiments of the clip 3 the third and fifth portions 33, 35 may extend partially through the first plane P.

Figure 1A:
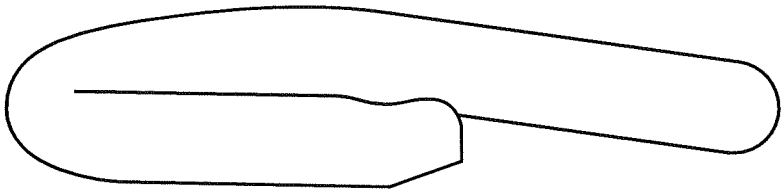
FIG. 1A PRIOR ART
FIG. 1A and FIG. 1B show respective prior art railway rail fastening clips.
Figure 1B:
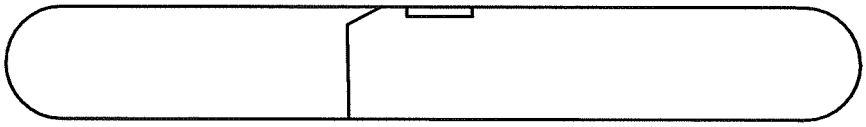

For a clip made of a rod of 15 mm diameter, typical dimensions A and B for the new clip are 32 mm and 26 mm respectively, whereas for the clip of FIG. 1A these dimensions are typically 30 mm and 10 mm respectively and for the clip of FIG. 1B these dimensions are typically 14 mm and 14.5 mm respectively.

Dimension C in the new clip is 45 mm.

In the embodiment shown the second and sixth portions 32, (rear arches) of the clip typically have a diameter of about 18.5 mm. In other embodiments of the clip this diameter may be between about 12 mm to 24 mm.

In an embodiment of the clip 3 the obtuse angle between the first plane P and the third plane Q is approximately 165° and the obtuse angle between the second plane R and the third plane Q is approximately 165°. Thus in this embodiment the second acute angle is approximately 15° and the first acute angle is approximately 30°.

In other embodiments of the clip, the first acute angle may be within the range 15° to 45° and the second acute angle $\beta$ may be within the range 0° to 20°, providing $\alpha>\beta$. An increase in angle $\alpha$ is desirably accompanied by a proportionate decrease in the angle $\beta$. For example, when $\alpha$ is around 45°, $\beta$ may be around 0°. In the case that $\beta$ is 0°, the third plane Q lies in the first plane P, such that the first and third planes, P and Q, are the same, or, if the third and fifth portions 33, 35 extend partially through the first plane P, the third plane Q is a plane lying parallel to but below the first plane P.

Detents are provided in upper surfaces of the clip legs 31, 37, adjacent to the ends E1, E2, for engaging with corresponding projections on an anchoring device, whereby the clip can be held in a pre-assembly position in which it is retained by the anchoring device but does not bear on the rail. At the ends E1, E2, a chamfer is provided for assisting the driving of the clip into an anchoring device.

Figure 3A:
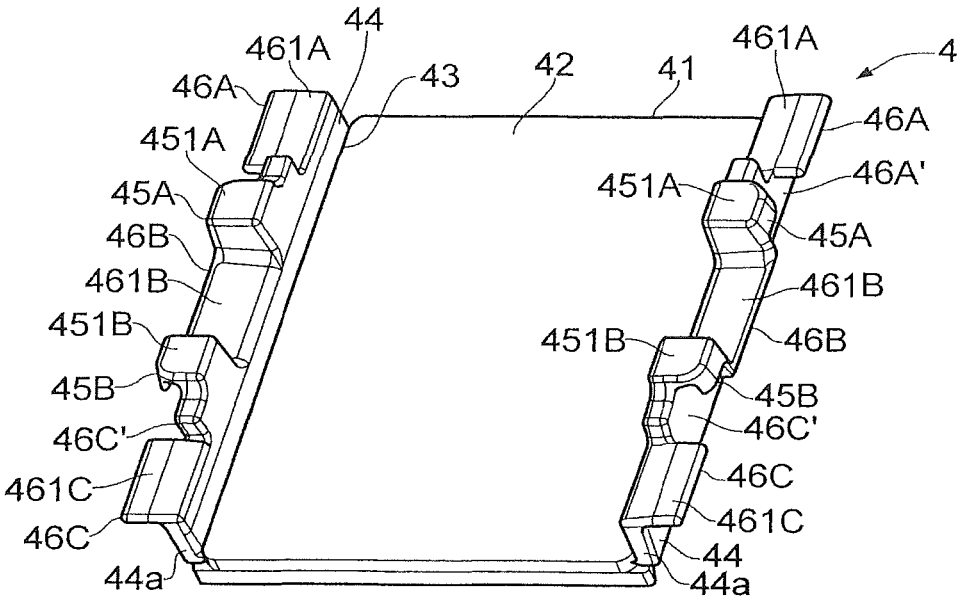
FIG. 3A, FIG. 3B, and FIG. 3C show respective perspective, plan and front elevational views of a rail pad embodying the second aspect of the present invention.
Figure 3B:
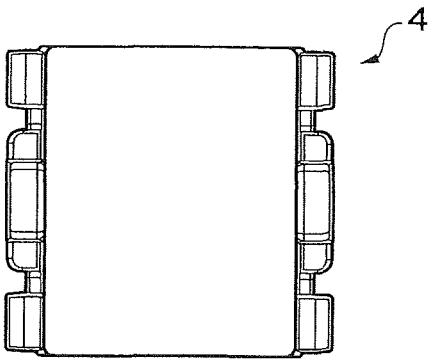
Figure 3C:
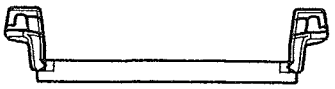

FIGS. 3A to 3C show a rail pad 4 with integral sideposts for use in a recessed railseat, in which projections from the sideposts can overlap the surface of the sleeper adjacent to the recess to resist ingress of water and debris. The pad is suitable for use with a resilient rail fastening clip, such as that of FIG. 2, which is configured to be driven onto and off the rail foot in a lateral direction with respect to the longitudinal axis of the rail. Rail pad 4 has a major face 41 providing a rail seat portion 42 on which the foot of the railway rail sits when the rail pad 4 is in use. The rail seat portion has opposite side edges 43 to at least part of each of which an upstanding portion 44 of the pad is connected. Each upstanding portion 44 is connected to the railseat portion 42 along the entire length of the upstanding portion 44 and extends upwardly therefrom. That is, all parts of the pad 4 connected to the railseat portion 42 extend substantially perpendicular thereto. Unlike the prior art pads, no part of the pad 4 is connected to the railseat portion 42 so as to extend laterally therefrom. Instead, each upstanding portion 44 is connected to at two projections 45A; 45B of the pad 4 each of which extends laterally from the upstanding portion 44 such that it is vertically spaced from, and does not overhang (i.e. extends away from), the rail seat portion 42. The projections 45A, 45B extend from upper edges of the upstanding portions 44. The projections 45A, 45B are spaced apart along the length of the upstanding portion 44 and extend along only part of the length of the upstanding portion 44 at a location along the length of the upstanding portion 44 which is spaced from ends 44*a* thereof. In this embodiment the projections 45A, 45B are centrally located with respect to the ends 44*a* of the upstanding portions 44.

The rail pad further comprises cover portions 46A, 46B, 46C connected to, and extending laterally from, each upstanding portion 44 at locations along its length such that the upstanding portion 44 is connected along its entire length to the projections 45A, 45B and the cover portions 46A, 46B, 46C. The projections 45A and 45B and the cover portion 46B which adjoins them could be regarded as forming a single projection. Cover portions 46A, 46C are provided with a notch 46A', 46C' for receiving part of a railway rail anchoring device 5.

In an alternative embodiment (not shown), instead of the notches 46A', 46C', gaps are provided between the cover portions 46A, 46C and the projections 45A, 45B located immediately adjacent thereto for receiving part of a railway rail anchoring device, in order to accommodate an anchoring device having parts which extend up to the edge of the recess.

In the embodiment shown, upper surfaces 451A, 451B of the projections 45A, 45B are higher with respect to the rail seat portion 42 than upper surfaces 461A, 461B, 461C of the cover portions 46A, 46B, 46C, such that there is more material, and hence strength, in the projections 45A, 45B.

Figure 4:
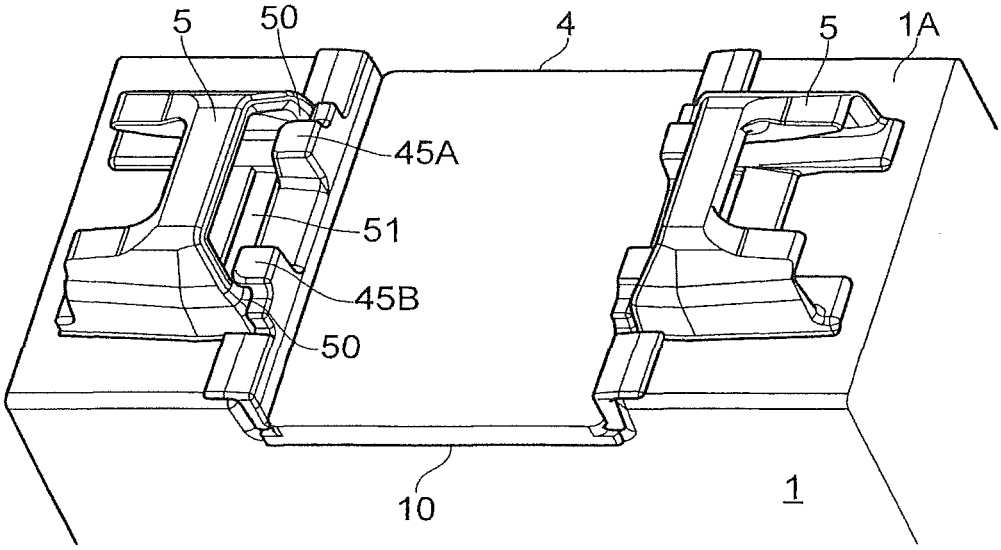
FIG. 4 shows an apparatus embodying the third aspect of the present invention, in which a rail pad embodying the second aspect of the present invention is located in a recessed railseat.

FIG. 4 shows apparatus comprising a rail pad 4 as shown in FIGS. 3A to 3C and a railway rail foundation 1 having an upper surface 1A formed with a recess 10 providing a seat for a railway rail 2 (see FIGS. 5A, 5B, and 5C). The rail pad 4 is located within the recess 10 such that the upstanding portions 44 of the pad 4 abut respective walls of the recess 10 and extend to the height of the walls of the recess 10. The projections 45A, 45B of the upstanding portions 44 extend over part of the upper surface 1A of the rail foundation 1.

Lower surfaces of the cover portions 46A to 46C contact the upper surface 1A of the sleeper 1 so as to provide a seal against the ingress of water and/or debris. In this embodiment, respective railway rail clip anchoring devices 5 are attached to the rail foundation 1 on opposite sides of the recess 4 such that front parts 50 of the anchoring devices 5 are spaced from edges of the recess 10 (although as mentioned above in an alternative embodiment the front parts 50 may extend up to the edge of the recess 10). The front part 50 of each anchoring device 5 has an opening 51, and the projections 45A, 45B of the rail pad 4 project into the openings 51, such that contact between the projections 45A, 45B and internal surfaces of the opening resists longitudinal movement of the pad.

The invention claimed is:

1. A rail pad for use as cushioning and/or electrical insulation beneath a foot of a railway rail in a recess formed in an upper surface of a railway rail foundation between railway rail clip anchoring devices, the rail pad comprising:

a major face forming a railseat portion, the foot of the railway rail sitting on the railseat portion when the rail pad is in use, the railseat portion having opposite side edges, a respective upstanding portion of the rail pad being connected to at least part of each of the opposite side edges, the respective upstanding portion being connected to the railseat portion along an entire length of the respective upstanding portion and extending upwardly therefrom; and cover portions connected to and extending laterally from the respective upstanding portion at respective first locations along the entire length of the respective upstanding portion, wherein the rail pad does not have any part which extends laterally from the railseat portion in a same plane as the railseat portion, wherein the respective upstanding portion is connected to at least one projection of the rail pad, the at least one projection extending laterally from the respective upstanding portion such that the at least one projection is vertically spaced from and does not overhang the railseat portion, the at least one projection extending along only part of the entire length of the respective upstanding portion at a respective second location along the entire length of the respective upstanding portion, the respective second location being spaced from ends of the respective upstanding portion, wherein upper surfaces of the at least one projection are higher with respect to the railseat portion than upper surfaces of the cover portions, and wherein at least one of the cover portions which is located immediately adjacent to the at least one projection is provided with a notch for receiving a respective part of a first of the railway rail clip anchoring devices.

2. A rail pad as claimed in claim 1, further comprising two projections spaced apart along the entire length of the respective upstanding portion and spaced from the ends.

3. A rail pad as claimed in claim 1, further comprising two projections and three cover portions, wherein the respective upstanding portion is connected along the entire length of the respective upstanding portion to the two projections and the three cover portions.

4. An apparatus comprising the rail pad as claimed in claim 1 and the railway rail foundation having the upper surface Ruined with the recess providing a seat for the railway rail, respective ones of the railway rail clip anchoring devices being attached to the railway rail foundation on opposite sides of the recess, the respective part of each of the railway rail clip anchoring devices having a corresponding opening, wherein, when the railseat portion of the rail pad is located in the recess, the at least one projection of the rail pad projects into the corresponding opening.

5. An apparatus as claimed in claim 4, wherein the respective part of each of the railway rail clip anchoring devices is spaced from edges of the recess.

6. A rail pad for use as cushioning and/or electrical insulation beneath a foot of a railway rail in a recess formed in an upper surface of a railway rail foundation between railway rail clip anchoring devices, the rail pad comprising:

a major face forming a railseat portion, the foot of the railway rail sitting on the railseat portion when the rail pad is in use, the railseat portion having opposite side edges, a respective upstanding portion of the rail pad being connected to at least part of each of the opposite side edges, the respective upstanding portion being connected to the railseat portion along an entire length of the respective upstanding portion and extending upwardly therefrom; and cover portions connected to and extending laterally from the respective upstanding portion at respective first locations along the entire length of the respective upstanding portion, wherein the rail pad does not have any part which extends laterally from the railseat portion in a same plane as the railseat portion, wherein the respective upstanding portion is connected to at least one projection of the rail pad, the at least one projection extending laterally from the respective upstanding portion such that the at least one projection is vertically spaced from and does not overhang the railseat portion, the at least one projection extending along only part of the entire length of the respective upstanding portion at a respective second location along the entire length of the respective upstanding portion, the respective second location being spaced from ends of the respective upstanding portion, a gap located between at least one of the cover portions and the at least one projection located immediately adjacent thereto for receiving a respective part of a first of the railway rail anchoring devices, and wherein upper surfaces of the at least one projection are higher with respect to the railseat portion than upper surfaces of the cover portions.

7. A rail pad as claimed in claim 6, further comprising two projections spaced apart along the entire length of the respective upstanding portion and spaced from the ends.

8. A rail pad as claimed in claim 6 further comprising two projections and three cover portions, wherein the respective upstanding portion is connected along the entire length of the respective upstanding portion to the two projections and the three cover portions.

9. An apparatus comprising the rail pad as claimed in claim 6 and the railway rail foundation having the upper surface formed with the recess providing a seat for the railway rail, respective ones of the railway rail clip anchoring devices being attached to the railway rail foundation on opposite sides of the recess, the respective part of each of the railway rail clip anchoring devices having a corresponding opening, wherein, when the railseat portion of the rail pad is located in the recess, the at least one projection of the rail pad projects into the corresponding opening.

10. An apparatus as claimed in claim 9, wherein the respective part of each of the railway rail clip anchoring devices is spaced from edges of the recess.

* * * * *